US006490770B1

(12) United States Patent
Matsuda et al.

(10) Patent No.: US 6,490,770 B1
(45) Date of Patent: Dec. 10, 2002

(54) SLIDER FOR SLIDE FASTENER

(75) Inventors: Yoshio Matsuda, Toyama-ken (JP); Morimasa Yoneoka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/512,858

(22) Filed: Feb. 24, 2000

(30) Foreign Application Priority Data

Mar. 17, 1999 (JP) ..... 11-071717

(51) Int. Cl.[7] ..... A44B 19/26

(52) U.S. Cl. ..... 024/428; 24/415; 24/426; 24/427

(58) Field of Search ..... 24/415, 426, 427, 24/428, 416–425

(56) References Cited

U.S. PATENT DOCUMENTS

| | | | | |
|---|---|---|---|---|
| 2,591,948 A | | 4/1952 | Lawson | |
| 3,011,251 A | | 12/1961 | McNamara | |
| 3,604,070 A | * | 9/1971 | Vorsteher | 24/426 |
| 3,818,549 A | * | 6/1974 | Moertel | 24/428 |
| 3,872,553 A | * | 3/1975 | Moertel | 24/428 |
| 4,133,084 A | * | 1/1979 | Yoshida | 24/413 X |
| 4,409,705 A | * | 10/1983 | Yuunaga | 24/415 |
| 4,455,722 A | * | 6/1984 | Oda | 24/427 |
| 4,562,622 A | * | 1/1986 | Takabatake | 24/427 |
| 5,497,535 A | * | 3/1996 | Kloor | 24/426 |

FOREIGN PATENT DOCUMENTS

| | | |
|---|---|---|
| FR | 1008966 | 5/1952 |
| GB | 1176652 | 1/1970 |

* cited by examiner

*Primary Examiner*—J. J. Swann
*Assistant Examiner*—Ruth C. Rodriguez
(74) *Attorney, Agent, or Firm*—Finnegan, Henderson, Farabow, Garrett & Dunner, L.L.P.

(57) ABSTRACT

The present invention provides a slider enabling a meshing position of a fastener chain inserted through a slider to be adjusted smoothly by pulling the fastener stringers in opposite directions along the fastener tape. This invention provides a slider for slide fastener wherein right and left flanges are provided on one of upper wing plate and lower wing plate of a slider body toward the other upper wing plate and lower wing plate, a wide end face portion extending in the right/left direction is provided at a front end located at shoulder side of the flange, a top surface of the pair of the flanges comprises a flat surface portion in parallel to the wing plates. Further, a protruded portion in a V-shape or upside-down V-shape is provided on the top surface from the front end to a central portion along an inner edge thereof on the flat surface portion. An inverted portion of the fastener element comes into contact with the wide end face portion formed on the flange, thereby preventing the elements from escaping from the flange or being caught by the flange. Further, the provision of the protruded portion prevents such troubles more securely and facilitates an operation for pulling the fastener chains in opposite directions along the fastener tape.

6 Claims, 9 Drawing Sheets

SLIDER FOR SLIDE FASTENER

BACKGROUND OF THE INVENTION

1. Field of the Invention

The present invention relates to a slider for use in a slide fastener having coil-shape fastener elements formed of monofilament of thermoplastic resin such as polyamide and polyester, and to a slider for slide fastener enabling an easy operation for pulling the fastener stringers in opposite directions along the fastener tape in order to adjust a combining position of the right and left fastener stringers and capable of sliding the slider smoothly without fastener elements escaping from the slider or flanges biting into fastener elements.

2. Description of the Related Art

Conventionally, there is disclosed in the U.S. Pat. No. 2,909,824, a slider for slide fastener in which a top surface 111, that is, a surface facing the fastener tape, of each of a pair of right and left flanges 105 for guiding a coil-shaped fastener elements disposed on upper and lower wing plates 102, 103 of the slider for slide fastener, is formed with a wide width as shown in FIG. 15.

Further, there is disclosed in the Japanese Utility Model Application No. 54-8885, a slider for slide fastener in which a pair of left and right flanges 205 for guiding coil-shaped fastener elements disposed on an inner face of upper wing plate 202 of the slider for slide fastener has an end face of a rear mouth 207 side thereof formed in a wide end face extending in the right/left direction of a body 201, as shown in FIG. 16.

Still further, there is disclosed in the Japanese Utility Model Application No. 61-1769, a slider for slide fastener in which, as shown in FIG. 17, a pair of right and left flanges 305 for guiding coil-shaped fastener elements disposed on upper and lower wing plates 302, 303 of the slide for slide fastener is provided with a step 314 on each surfaces facing vertically, such that a protruded portion 313 is formed on each of top surfaces of the flanges 305.

Each of the aforementioned conventionally known slider for slide fastener has a part of features which the present invention includes. A long coil-shaped fastener chain is cut to a desired length depending on a shape of an object to be attached such as a bag or clothes and sewed to an object to be attached. During the sewing, it is necessary to attach a slider, bottom stopper, front stopper and the like. At this time, when one fastener stringer is inserted through the slider, the other fastener stringer is inserted after that, and after both of the fastener stringers are combined at an arbitrary position, one fastener stringer is pulled strongly so that ends of both fastener stringers are matched at the same position, or when the right and left fastener stringers are pulled in the right/left direction, the coil-shaped fastener element is likely to escape over the flange out of a guide groove of a body. In the aforementioned conventional slider, any measure for avoiding this trouble has not been achieved.

When the slider is slid in a closing direction with a pulling force in the right/left direction being applied to the right and left fastener stringers which has not been completely closed, a front end of the flange may intrude into a gap between the adjacent fastener elements attached along a side edge of the fastener tape, so that the slider is unable to slide. In the aforementioned conventional slider, any measure for solving this problem has not been achieved either.

SUMMARY OF THE INVENTION

The present invention has been accomplished in views of the above described problems. The main object of the present invention is to provide a slider for slide fastener having a simple preventive mechanism for preventing the coil-shaped fastener elements from escaping from the slider or a front end of the flange from intruding into a gap between the fastener elements so that the slider is unable to slide, when both right and left fastener stringers are pulled strongly in opposite directions along the fastener tape to adjust the positions thereof, after the right and left fastener stringers are inserted through the slider when a fastener chain having the coil-shaped fastener elements is sewed to an object to be attach and the slider, bottom stopper, front stopper and the like are attached to the fastener chain, or when an operation for sliding the slider in a closing direction is carried out with a pulling force in the right/left direction applied to the engaged right and left fastener stringers.

Another object of the present invention is to provide a slider for slide fastener suitable for a fastener chain of a type of which fastener elements exist on one surface of a fastener tape; in which the coil-shaped fastener elements are sewed and attached to a single side surface, that is, to one surface of the fastener tape.

It is an object of the present invention to provide a slider for slide fastener suitable for a fastener chain of a type in which a core thread is inserted through the coil-shaped fastener elements and the fastener elements are woven into a side edge of the fastener tape while weaving the fastener tape, so that the fastener elements exist on both sides of the fastener tape.

It is another object of this invention to provide a slider for slide fastener for enabling an operation for pulling the fastener chain in opposite directions along the fastener tape smoothly and achieving a smooth slide of the slider and capable of preventing the coil-shaped fastener elements from escaping from of the slider by the pulling force in opposite directions along the fastener tape or in the right/left direction, by specifying a plan configuration of a pair of the right and left flanges provided so as to erect on the slider body.

It is also an object of the present invention to provide a slider for slide fastener in which a protruded portion is formed on a top surface of each of a pair of the right and left flanges erected on the slider body, so as to reduce the size of a gap between the flange and fastener tape, thereby making it possible to securely prevent the coil-shaped fastener elements from escaping from the slider when the fastener chain is pulled in opposite directions along the fastener tape or in the right/left direction with respect to the fastener tape.

Another object of the present invention is to provide a slider for slide fastener capable of effectively and appropriately preventing the coil-shaped fastener elements from escaping from the slider or the fastener tape from being damaged when the fastener chain is pulled in opposite directions along the fastener tape or in the right/left direction, by specifying a relational configuration of the protruded portion, and the protruded portion and the flat surface portion.

Still another object of the present invention is to provide a slider for slide fastener capable of preventing the flange from biting into an adjacent wale surface of a warp knitted fastener tape by specifying a relation between the wale of the warp knitted fastener tape and an erected flange provided on the slider body.

Finally, an object of the present invention is to provide a slider for slide fastener which the slider can be used not only for the coil-shaped fastener elements but also for a fastener chain having various types of fastener elements such as single-body type fastener elements, formed of metallic or thermoplastic resin single body and further in which the slider can be slid smoothly even when a pulling force in the right/left direction is applied to the right and left fastener stringers.

To achieve the above object, according to the first ,aspect, there is mainly provided a slider for slide fastener including a pair of right and left flanges 5 erected on one of upper wing plate and lower wing plate 2, 3 of a slider body 1 toward the other upper wing plate 2 and lower wing plate 3 for guiding fastener elements 22, a wide end face portion 10 having a wide configuration extending in the right/left direction of the body 1 being provided at a front end 8 located at the side of shoulders 6 of the body 1 of the flanges 5, and a top surface 11 of the pair of the flange 5 including a flat surface portion 12 formed in parallel to the upper wing plate and lower wing plate 2, 3.

Preferably, there is provided a slider for slide fastener of a type in which the coil-shaped fastener elements 22 exist on a single side face of the fastener tape; a type in which a pair of the right and left flanges 5 erected on any one of the wing plates 2,3 of the slider body 1 toward the other wing plates 2,3 are provided on any one of the wing plates 2,3.

Further preferably, there is provided a slider for slide fastener of a type in which the coil-shaped fastener elements 22 exist on both faces of the fastener tape; a type in which a pair of the right and left flanges 5 are provided on an inner face of each of the upper wing plate and lower wing plate 2, 3 of the slider body 1 such that they are erected so as to face each other.

Still preferably, there is provided a slider for slide fastener including a pair of the right and left flanges 5 provided on the upper and lower wing plates 2, 3 of the slider body 1 or any one of the upper and lower wing plates 2, 3, wherein a lateral width of the flange 5 at the front end 8 located at the shoulder 6 side of the slider body 1 is larger than the lateral width thereof at a rear end 9 located at a rear mouth 7 side of the slider body 1, while the lateral width expands gradually from the rear mouth 7 side toward the front end 8.

It is preferable that there is provided a slider for slide fastener including a pair of the right and left flanges 5 provided on the upper and lower wing plates 2, 3 of the slider body 1 or any one of the upper and lower wing plates 2, 3, wherein the wide end face portion 10 having a wide configuration extending in the right/left direction of the slider body 1 is provided at the rear end 9 located at the rear mouth 7 of the slider body 1, so that the flange 5 is entirely formed in a large width.

It is also preferable that there is provided a slider for slide fastener, including a pair of the right and left flanges 5 provided on the upper and lower wing plates 2, 3 of the slider body 1 or any one of the upper and lower wing plates 2, 3, wherein a protruded portion 13 is formed on the flat surface portion 12 of the top surface 11 of each of the flanges 5 from the front end 8 located at the shoulder 6 side of the slider body 1 to a central portion of the flange 5, such that the protruded portion 13 is protruded toward the opposing wing plates 2, 3.

It is further preferable that there is provided a slider for slide fastener including a pair of the right and left flanges 5 provided on the upper and lower wing plates 2, 3 of the slider body 1 or any one of the upper and lower wing plates 2, 3, wherein the protruded portion 13 formed on the flat surface portion 12 of the top surface 11 of the flange 5 is formed so as to protrude along an inner edge of the flange 5 from the front end 8 of the shoulder 6 side of the body 1 of the flanges 5.

It is still preferable that there is provided a slider for slide fastener including a pair of the right and left flanges 5 provided on the upper and lower wing plates 2, 3 of the slider body 1 or any one of the upper and lower wing plates 2, 3, wherein a gentle slope portion 14 is formed on a border between the protruded portion 13 formed on the top surface 11 of the flange 5 and the flat surface portion 12.

Further preferably, there is provided a slider for slide fastener including a pair of the right and left flanges 5 provided on the upper and lower wing plates 2, 3 of the slider body 1 or any one of the upper and lower wing plates 2, 3, wherein the top surface 11 of the flange 5 has at least a width for covering a single wale 25 woven on a warp knitted fastener tape 24.

Finally, it is preferable that there is provided a slider for slide fastener, wherein the wide end face portion 10 having a lateral width larger than a gap between adjacent fastener elements 22 of the fastener elements 22 attached to a side edge of a fastener tape is provided at the front end 8 of the flange 5 erected on the upper and lower wing plate 2,3 of the slider body 1, so that ends of the fastener elements 22 are always in contact with the wide end face portion 10 at any situation.

DESCRIPTION OF THE PREFERRED EMBODIMENTS

Hereinafter, the embodiments of a slider for slide fastener of the present invention will be described in detail with reference to the accompanying drawings.

Figure 1:
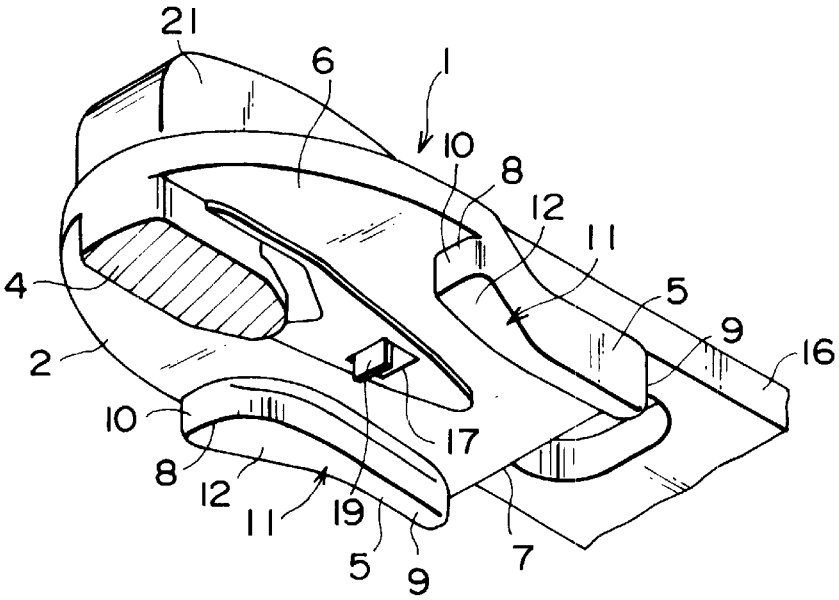
FIG. 1 is a partially broken perspective view showing an inner face of an upper wing plate of a slider for slide fastener according to a first embodiment.
Figure 2:
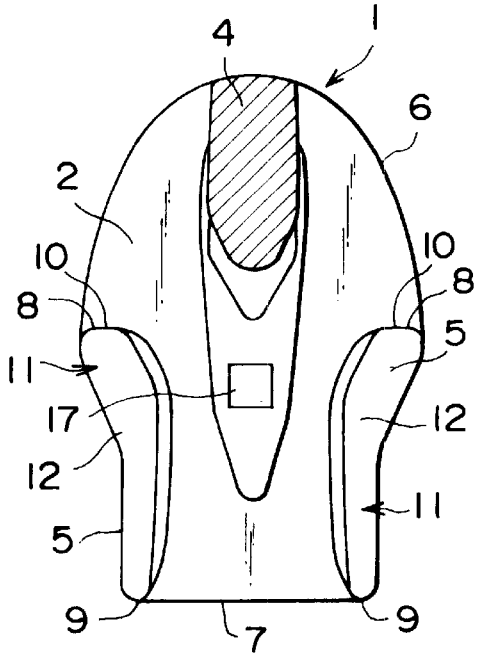
FIG. 2 is a sectional view showing an inner face of the upper wing plate of the slider.
Figure 3:
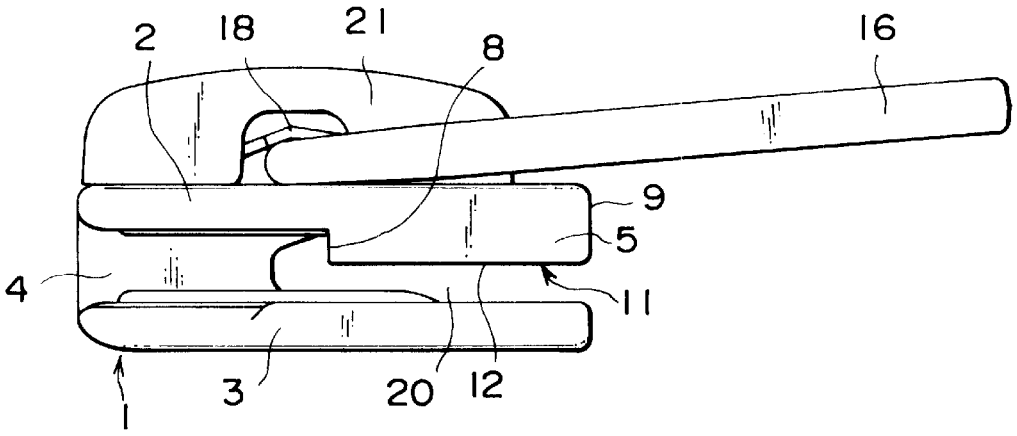
FIG. 3 is a side view of the slider.

In the slider for slide fastener of the present invention, a body 1 of the slider is molded by die-casting, for example, zinc alloy, aluminum alloy or the like. In the slider body 1, as shown in FIG. 3, an upper wing plate 2 and a lower wing plate 3 are connected via a guide post 4. A flange 5 for guiding fastener elements 22 is provided on inner faces of both sides of the upper wing plate 2 so as to erect toward the lower wing plate 3. In this flange 5, as shown in FIGS. 1 and 2, a flat wide end face portion 10 having a laterally large width in plan configuration, extending linearly in a lateral direction of the body 1, that is, in the right/left direction is provided at a front end 8 located at a shoulder 6 side of the body 1, and the lateral width of a rear end 9 located at a rear mouth 7 side of the body 1 of the flange 5 is smaller. Therefore, the lateral width expands gradually from the rear end 9 toward the front end 8. A top surface 11 of the flange 5 is formed as a flat surface portion 12 in parallel to the upper wing plate 2 or lower wing plate 3, and a gap between the lower wing plate 3 and the flat surface portion 12 formed on the top surface 11 of the flange 5 is formed so as to be slightly larger than the thickness of the fastener tape.

In the slider body 1, a pawl hole 17 is formed at the rear mouth 7 side with respect to the guide post 4 so that a locking pawl 19 of a plate spring 18 is capable of coming in/out. The locking pawl 19 is formed so that it is capable of coming in/out from a guide groove 20 for guiding the fastener elements 22 of the body 1 by a pulling operation of a pull tab 16. Reference numeral 21 indicates a cover. This slider is suitable for a fastener chain of a type in which the fastener elements exist on a single surface of the fastener tape, with the coil-shaped fastener elements 22 attached on a single side edge of the fastener tape.

Figure 4:
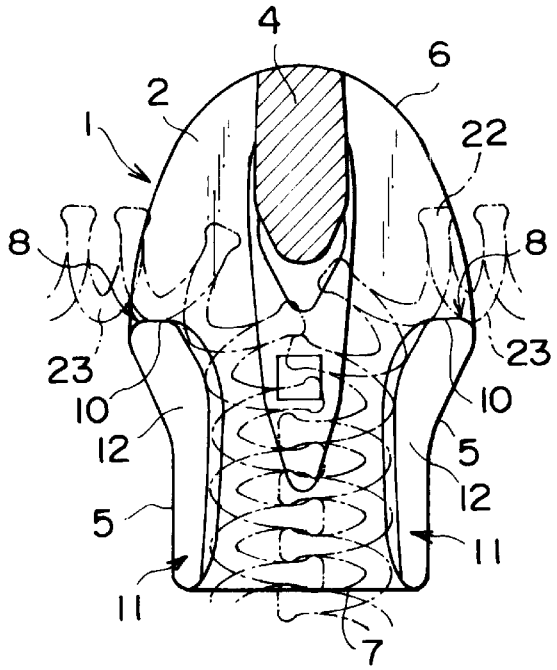
FIG. 4 is a sectional view showing an operating condition of the slider.
Figure 5:
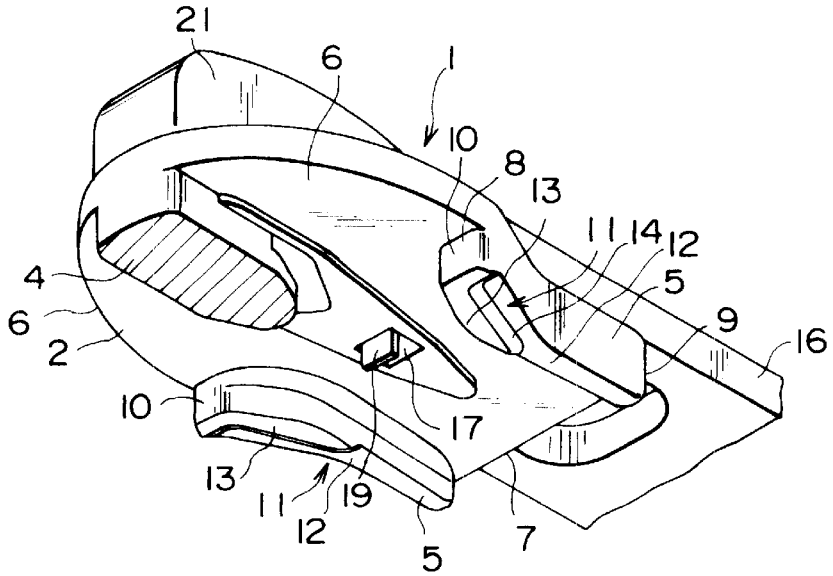
FIG. 5 is a partially broken perspective view showing an inner face of the upper wing plate of the slider for slide fastener according to a second embodiment.
Figure 6:
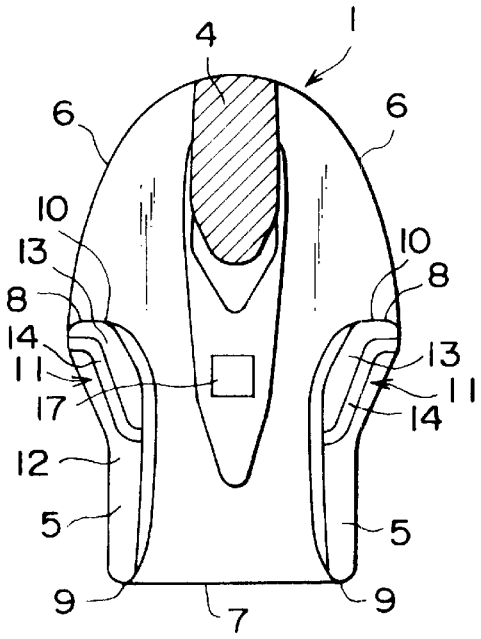
FIG. 6 is a sectional view showing an inner face of the upper wing plate of the slider.

A characteristic of the slider of the present invention will be described below. When the fastener chain is being sewed to an object to be attached such as clothes, it is cut into a predetermined length and sewed. During this sewing, a slider, a bottom stopper, a front stopper and the like are attached. After one fastener stringer is inserted through the slider, the other fastener stringer is inserted through the slider, and then, both fastener stringers are meshed with each other at an arbitrary position, and after that, by pulling one fastener stringer, ends of the right and left fastener stringers are forced to match each other. In this operation, or when the slider is slid in a closing direction while a pulling force in the right/left direction is applied to the right and left fastener stringers, or when the right and left fastener stringers are pulled in the right/left direction, as shown in FIG. 4 for example, the coil-shaped fastener elements 22 are pulled in the right/left direction at the front end 8 of the flange 5 of the slider, so that an interval between adjacent element leg portions of the coil-shaped fastener elements 22 is widened and consequently, it prevents the front end 8 of the flange 5 from climbing over an inverted portion 23 to intrude between the element leg portions, which causes an obstruction of a sliding of the slider.

To prevent the coil-shaped fastener elements 22 from escaping from the slider, the wide end face portion 10, which the adjacent inverted portions 23 of the coil-shaped fastener elements 22 come into contact with, is provided at the front end 8 of the flange 5, so that it is difficult for the front end 8 to climb over the inverted portion 23 and for the coil-shaped fastener elements 22 to escape from between the top surface 11 of the flange 5 and the lower wing plate 3. Therefore, a conventional problem of the inverted portion of coil-shaped fastener elements intruding into a narrow front end of the flange and obstructing the slider to slide can be solved.

A slider according to a second embodiment will be described with reference to FIGS. 5 to 8. What is different from the aforementioned first embodiment is a configuration of the top surface 11 of the flange 5 provided to erect toward the lower wing plate on each inner face of both sides of the upper wing plate 2 of the slider body 1. On the flat surface portion 12 of the top surface 11 of the flange 5, a protruded portion 13 is provided along an inner edge from the wide end face portion 10 formed at the front end 8 of the flange 5 up to a central portion of the flange 5, such that it is protruded further toward the lower wing plate 3. This protruded portion 13 is protruded in a V-shape or an upside-down V-shape. A gentle slope portion 14 is formed on a border between the V-shaped protruded portion 13 and the flat surface portion 12 so as to reduce a friction between the protruded portion 13 and fastener tape, thereby achieving a smooth sliding of the slider.

Figure 7:
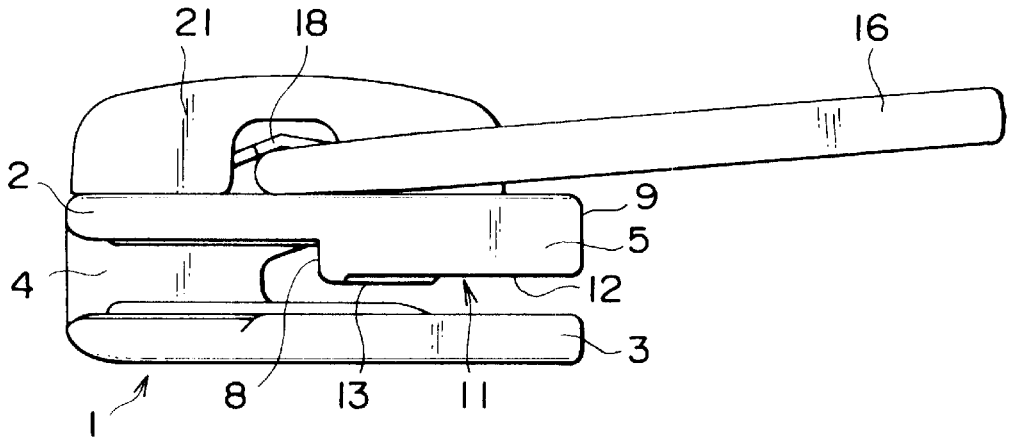
FIG. 7 is a side view of the slider.

In this slider as shown in FIG. 7, the protruded portion 13 is formed on a front half of the flat surface portion 12 on the top surface 11 of the flange 5 such that it is protruded toward the lower wing plate 3. Thus, the gap between the top surface 11 of the flange 5 and the lower wing plate 3 is smaller than the slider of the first embodiment, so that intrusion and fitting of the front end 8 of the flange 5 into the inverted portion 23 of the coil-shaped fastener elements 22 can be prevented more securely.

Figure 8:
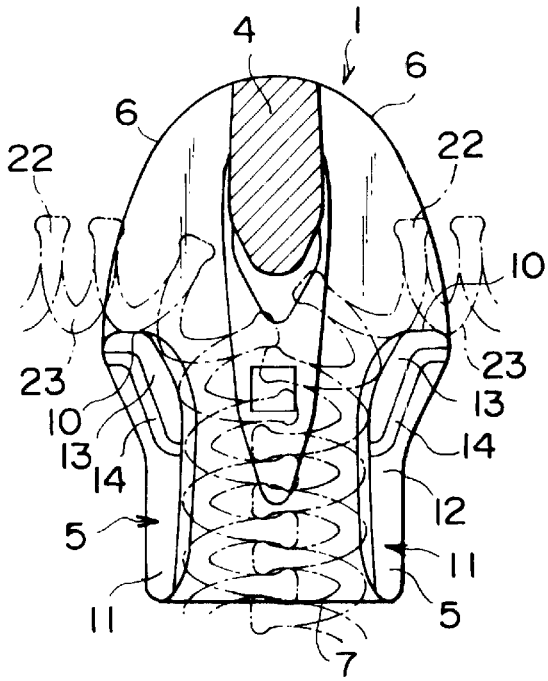
FIG. 8 is a sectional view showing an operating condition of the slider.

Further, as shown in FIG. 8, since the protruded portion 13 is formed along the inner edge of the flat surface portion 12 from the front end 8 of the flange 5 to the central portion, a ratio of the area occupied by the protruded portion 13 in the flat surface portion 12 is decreased, so that a frictional resistance which is caused by a contact between the protruded portion 13 and the fastener tape can be minimized when the slider is slid.

Figure 9:
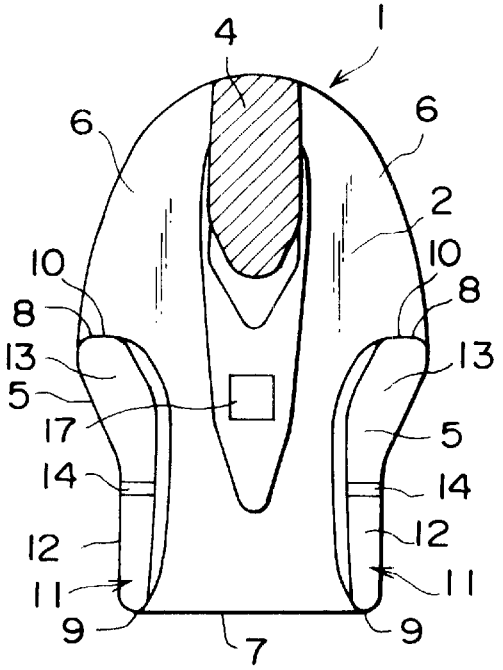
FIG. 9 is a sectional view showing an inner face of the upper wing plate of the slider for slide fastener according to a third embodiment.

In a slider according to a third embodiment shown in FIG. 9, the flanges 5 are provided on an inner face of both sides of the upper wing plate 2 of the slider body 1 such that they are erected toward the lower wing plate 3. The protruded portion 13 is formed so as to protrude toward the lower wing plate 3 on the flat surface portion 12 on the top surface 11 of the flange 5. This protruded portions 13 are provided on the flat surface portion 12 from the wide end face portion 10 formed at the front end 8 of the flange 5 up to the central portion of the top surface 11 of the flange 5 such that they are entirely protruded in parallel to the upper wing plate 2.

Also in this slider, since the protruded portions 13 are formed on a front half portion of the flat surface portion 12 on the top surface 11 of the flange 5 such that they are protruded toward the lower wing plate 3, a gap between the top surface 11 of the flange 5 and the lower wing plate 3 becomes smaller than the slider of the first embodiment. As a result, intrusion and fitting of the front end 8 of the flange 5 into the inverted portion 23 of the coil-shaped fastener elements can be prevented more securely.

Figure 10:
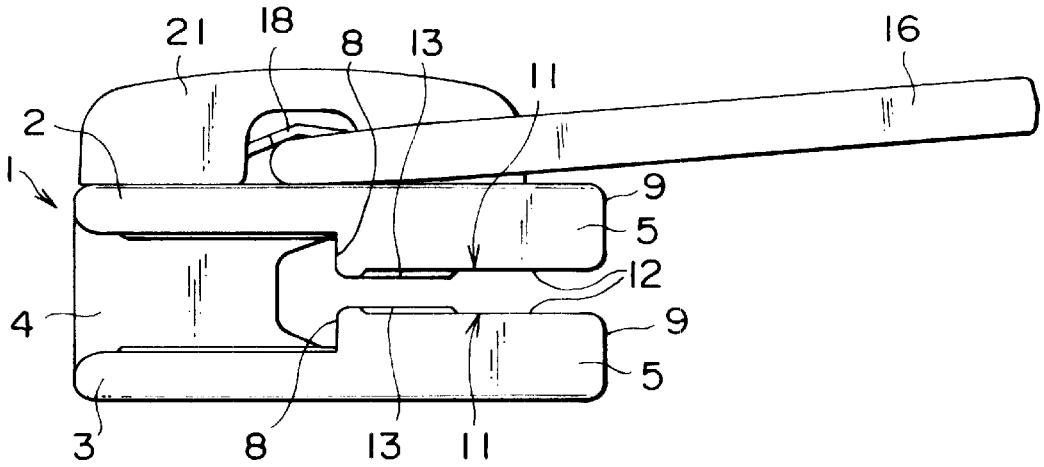
FIG. 10 is a side view of the slider for slide fastener according to a fourth embodiment.

In a slider according to a fourth embodiment shown in FIG. 10, the flanges 5 erected toward the wing plates 2, 3 facing each other are provided on inner faces on both sides of each of the upper wing plate 2 and lower wing plate 3. Then, the protruded portion 13 is provided on the flat surface portion 12 along an inner edge of the top surface the flange 5 such that it is protruded in parallel to the upper wing plate 2 and lower wing plate 3 in a V-shape or an upside-down V-shape. The protruded portion 13 is formed from the wide end face portion 10 formed at the front end 8 of the flange 5 up to the central portion on the top surface 11 of the flange 5 such that it is protruded.

This type of slider is suitable for a fastener chain of a type in which the coil-shaped fastener elements 22 exist on both surfaces of the fastener tape so as to be projected therefrom; type of a fastener chain in which a fastener element row with a core thread inserted through the coil-shaped fastener elements 22 is woven into one side edge of the fastener tape while the fastener tape is being woven.

Also in this slider, the protruded portion 13 is provided along the inner edge of the front half portion of the flat surface portion 12 on the top surface 11 of the flange 5 of each of the upper wing plate 2 and lower wing plate 3 so as to protrude toward the wing plates 2, 3 which face each other. Therefore, a gap between the top surface 11 of one flange 5 and the top surface 11 of the other opposing flange 5 is smaller than the slider of the first embodiment, so that intrusion and fitting of the front end 8 of the flange 5 into the inverted portion 23 of the coil-shaped fastener elements 22 can be prevented more securely.

Figure 11:
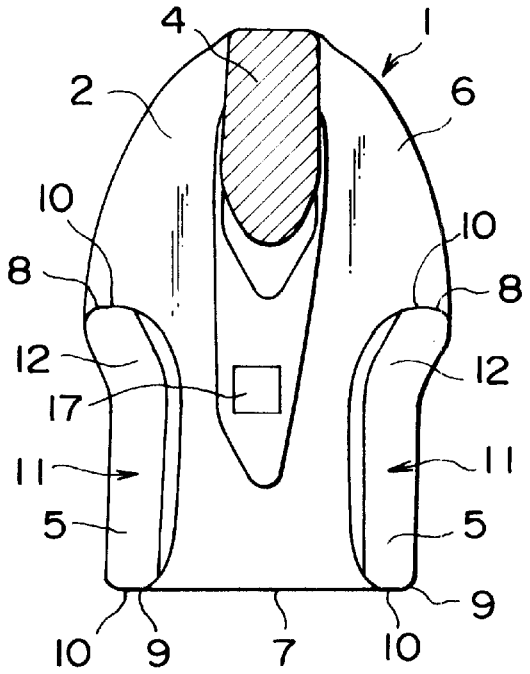
FIG. 11 is a sectional view showing an inner face of the upper wing plate of the slider for slide fastener according to a fifth embodiment.

In a slider according to a fifth embodiment shown in FIG. 11, the flange 5 is provided on the inner face of both sides of the upper wing plate 2 of the slider body 1 so as to erect toward the lower wing plate 3. This flange 5 is formed from the wide end face portion 10 formed at the front end 8 up to the rear mouth 7 of the body 1 such that a lateral width of the entire flange 5 is substantially the same. By also forming the wide end face portion 10 having a large width at the rear mouth 9, the flat surface portion 12 having a large width is formed on the entire top surface 11 of the flange 5.

Because this slider has the wide end face portion 10 at the rear end 9 as well as the front end 8 of the flange 5, when the right and left fastener stringers are pulled in opposite directions along the fastener tape, the wide end face portion 10 of the rear end 9 may also come into contact with the adjacent inverted portions 23 of the coil-shaped fastener elements 22 similar to the front end 8. Consequently, the rear end 9 as well as the front end 8 never climbs over the inverted portion 23 of the coil-shaped fastener elements 22 at the rear and front portions of the flange 5 to fit into the adjacent element leg portions. Thus, the operation of the slider is not obstructed.

Figure 12:
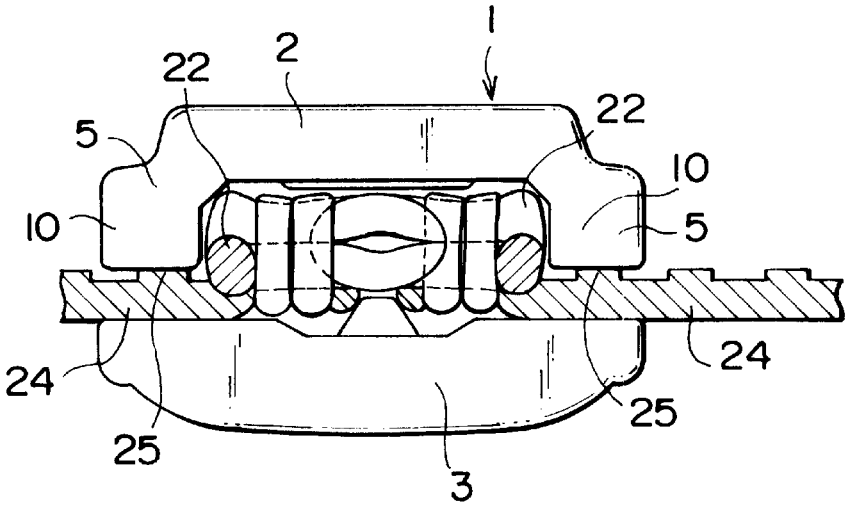
FIG. 12 is a bottom view showing the slider in use.

This slider is suitable for a fastener chain of a type in which a fastener tape 24 is a warp knitted fastener tape 24, and the coil-shaped fastener elements 22 are sewed on the fastener tape 24 in which wales 25 are knitted on a surface thereof as shown in FIG. 12. The top surface 11 of the flange 5 having a large lateral width faces the surface of the wale 25 of the warp knitted fastener tape 24 so that it covers the wale 25.

Therefore, when the slider slides over the warp knitted fastener tape 24, a face-contacting portion between the top surface 11 of the flange 5 of the slider and the surface of the wale 25 can be secured sufficiently so that the flange 5 and wale 25 support each other, so that an outer edge portion or an inner edge portion of the flange 5 never bites into a groove portion between the adjacent wales 25 of the warp knitted fastener tape 24. As a result, the slider is capable of sliding smoothly and further, this slider never gives such a damage to the warp knitted fastener tape 24 as thread breakage.

Although a scope of application of the slider has been described about a fastener chain provided with the coil-shaped fastener elements formed of thermoplastic resin monofilament, the slider of the present invention is not restricted to the coil-shaped fastener elements, but may be applied as a slider for a fastener chain in which a single-body type fastener elements each formed of a metallic or thermoplastic resin single body is attached to a side edge of the fastener tape. Although the fastener chain having the single-body type fastener elements cannot be operated such that the right and left fastener stringers are pulled in opposite directions along the fastener tape, this slider is preferable as a slider for sliding the slider to close the slide fastener attached to an opening of a bag filled with plenty of contents, that is, when a pulling force in the right/left direction is exerted on the engaged right and left fastener stringers.

Figure 13:
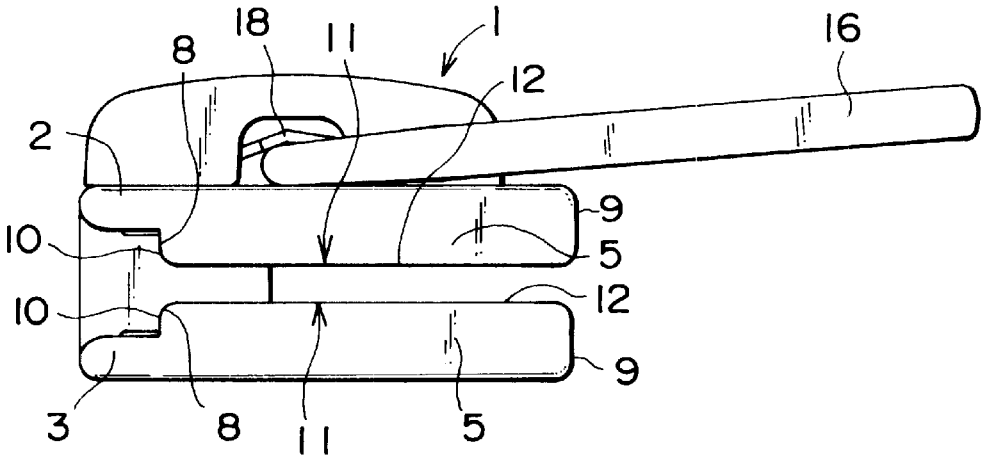
FIG. 13 is a side view of the slider for slide fastener according to a sixth embodiment.
Figure 14:
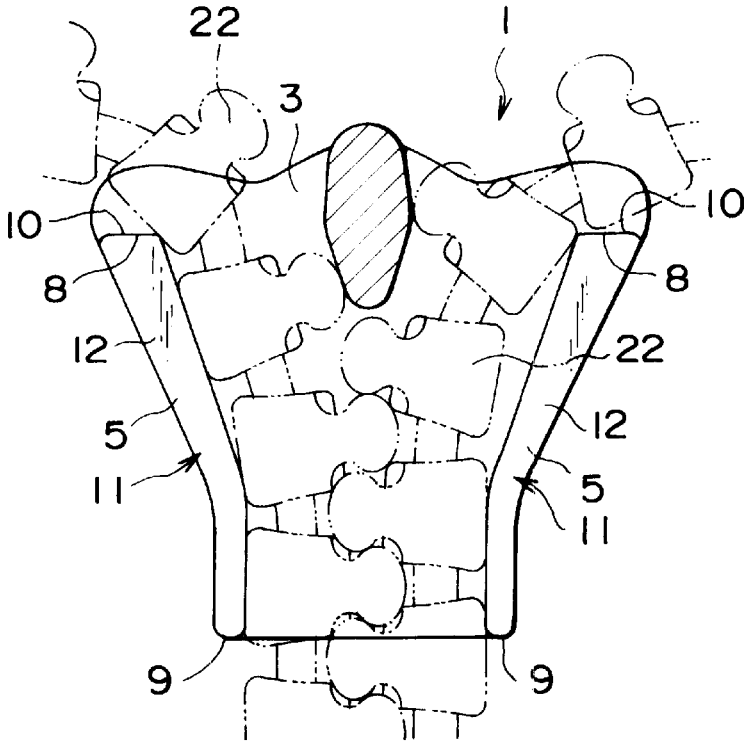
FIG. 14 is a sectional view showing an operating condition of the slider.
Figure 15:
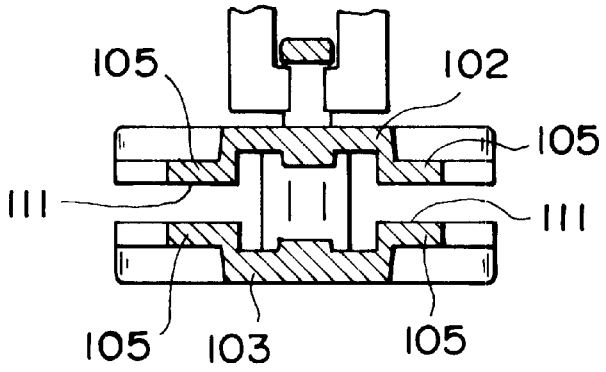
FIG. 15 (PRIOR ART)
FIG. 15 is a lateral sectional view of a known slider.
Figure 16:
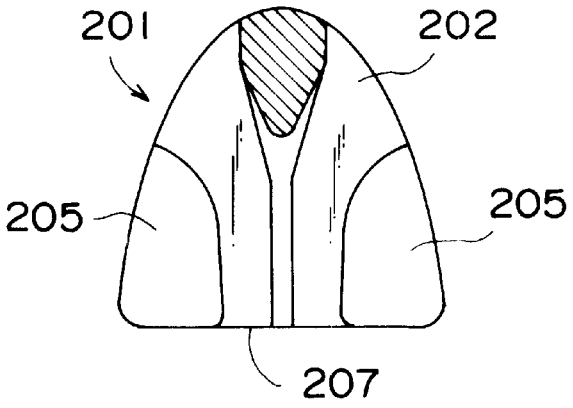
FIG. 16 (PRIOR ART)
FIG. 16 is a sectional view showing an inner face of a lower wing plate of another known slider.
Figure 17:
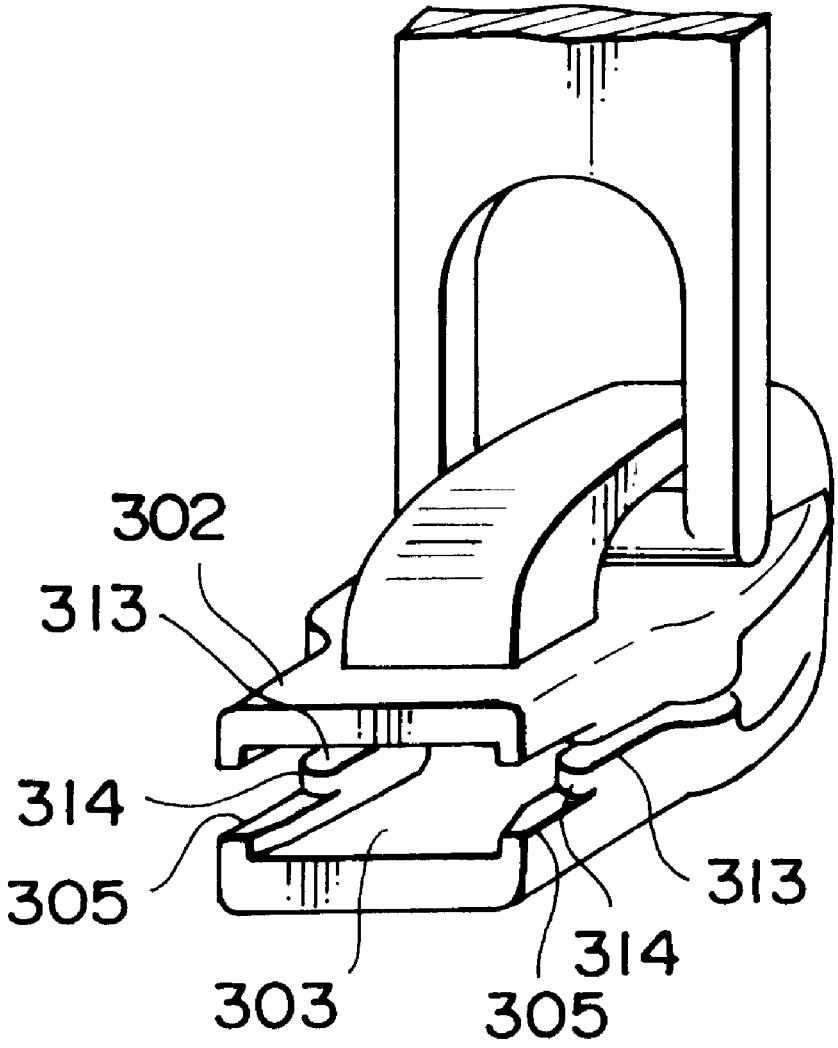
FIG. 17 (PRIOR ART)
FIG. 17 is a perspective view of still another known slider.

In a slider to be used for a fastener chain having the single-body type fastener elements, as shown in FIGS. 13 and 14, the flanges 5 are erected on the inner faces on both sides of each of the upper wing plate 2 and lower wing plate 3 of the slider body 1 toward the opposing wing plates 2, 3. In each of the flanges 5, the flat surface portion 12 with the flat top surface 11 is formed from the front end 8 to the rear end 9 and the flat wide end face portion 10 is formed at the front end 8 of each of the flanges 5 which face each other vertically such that it is extended in the right/left direction of the body 1.

This wide end face portion 10 is formed with a lateral width larger than a gap between the adjacent fastener elements 22 of the single-body type fastener elements 22 injection-molded with thermoplastic resin on a side edge on the fastener tape. Therefore, when the slider is slid in a closing direction when a pulling force in the right/left direction is exerted to the right and left fastener stringers as shown in FIG. 14, end edges of the fastener elements 22 come into contact with the wide end face portion 10 at the front end 8 of the flange 5 successively. Thus, even when the slider is slid by force, a conventional problem that the flange of the slider biting into a gap between the fastener elements so that the slider is unable to slide never occurs. Further, it is permissible to provide the flat surface portion 12 on the top surface 11 of the flange 5 with the protruded portion 13 described in the previous embodiment.

The slider for slide fastener of the present invention has the above described feature, and with such a feature, the following effects can be achieved.

According to the present invention, there is provided a slider for slide fastener including a pair of flanges 5 erected on one of upper wing plate 2 and lower wing plate 3 of a slider body 1 toward the other one thereof, a wide end face portion 10 extending in the right/left direction of the body 1 is provided at a front end 8 of each of the flanges 5, and a top surface 11 of the flange 5 is provided with a flat surface portion 12 in parallel to the upper wing plate 2 and lower wing plate 3. Therefore, when both fastener stringers are pulled strongly in opposite directions along the fastener tape or when the slider is slid in a closing direction with a pulling force in the right/left direction being applied, the adjacent inverted portions 23 of the coil-shaped fastener elements or an end edge of an single-body type fastener elements independently made of metal or thermoplastic resin come into contact with the wide end face portion 10 of the flange 5, thereby preventing the front end 8 of the flange 5 from climbing over the inverted portions 23 of the coil-shaped fastener elements and fitting into the adjacent fastener elements 22, or the front end 8 of the flange 5 from biting into a gap between the single-body type fastener elements obstructing a slide of the slider, or the coil-shaped fastener elements from escaping from the slider.

Further, there is provided a slider for slide fastener, wherein a pair of the flanges 5 erected on any one of the wing plates of the upper and lower wing plates 2,3 toward the other wing plate 2, 3 are provided on one of the wing plates 2,3. Therefore, it is possible to easily provide a slider suitable for a fastener chain in which the coil-shaped fastener elements are attached to a single side face of the fastener tape.

There is also provided a slider for slide fastener, wherein a pair of the flanges 5 are provided on an inner face of each of the upper wing plate 2 and lower wing plate 3 such that they erect to oppose each other. Therefore, it is possible to easily provide a slider suitable for a fastener chain in which the coil-shaped fastener elements are attached to one side of the fastener tape such that they project on both surfaces.

Further, there is provided a slider for slide fastener, wherein a lateral width of the flange 5 at a front end 8 located at a shoulder 6 side thereof is larger than the lateral width thereof at a rear end 9 located at a rear mouth 7 side, while the lateral width expands gradually from the rear end 9 toward the front end 8. Therefore, an escape of the fastener elements from the shoulder 6 side of the slider is prevented and an area of the flat surface portion 12 formed on the top surface 11 of the flange 5 is minimized so as to reduce a frictional resistance which is caused by a contact between the flat surface portion 12 and the fastener tape during a sliding of the slider.

Still further, there is provided a slider for slide fastener, wherein the wide end face portion 10 extending in the right/left direction of the body 1 is provided at the rear end 9 located at a rear mouth 7 side of the flange 5, while the flange 5 is entirely formed in a large width. Therefore, when the right and left fastener stringers are pulled strongly in opposite directions along the fastener tape, the inverted portion 23 of the coil-shaped fastener elements comes into contact with the wide end face portion 10 at the rear end 9 of the flange 5 thereby preventing the coil-shaped fastener elements from escaping from the rear end 9 of the flange 5.

Furthermore, there is provided a slider for slide fastener, wherein a protruded portion 13 is formed on the flat surface portion 12 of the top surface 11 of each of the flanges 5 from the front end 8 located at the shoulder 6 side to a central portion of the flange 5, such that the protruded portion 13 is protruded toward the opposing wing plates 2,3. Therefore, a gap between the flange 5 and fastener tape is narrowed thereby preventing securely the coil-shaped fastener elements from escaping from the front end 8 of the flange 5 when the fastener chain is pulled strongly in opposite directions or in the right/left direction.

There is also provided a slider for slide fastener, wherein the protruded portion 13 formed on the top surface 11 of the flange 5 is formed along an inner edge of the flange 5 from the front end 8 thereof. Therefore, an area of the protruded portion 13 facing the fastener tape is decreased thereby a frictional resistance when sliding the slider caused by a contact between the fastener tape and protruded portion 13 being reduced so as to achieve a smooth sliding of the slider.

Further, there is provided a slider for slide fastener, wherein a slope portion 14 is formed on a border between the protruded portion 13 formed on the top surface 11 of the flange 5 and the flat surface portion 12. Therefore, the top surface 11 of the flange 5 is a smooth surface without an extreme step, so that the sliding operation of the slider can be achieved smoothly and further the fastener tape is never damaged.

Still further, there is provided a slider for slide fastener, wherein the flange 5 is formed such that the top surface 11 thereof faces the wale 25 of the warp-knitted fastener tape 24, and the top surface 11 has a lateral width which can cover the wale 25. Therefore, an outer edge or inner edge of the flange 5 never bites into a groove between the adjacent wales 25 of the warp knitted fastener tape 24 during a sliding of the slider, thereby preventing securely the warp knitted fastener tape from being damaged and achieving a smooth sliding operation of the slider.

Furthermore, there is provided a slider for slide fastener, wherein the wide end face portion 10 provided at the front end 8 of the flange 5 has a lateral width larger than a gap between adjacent fastener elements 22 of the fastener elements 22 attached to a side edge of a fastener tape. Therefore, this slider can be used not only for the coil-shaped fastener elements but also the fastener chain having various kinds of fastener elements, such as single-body type fastener elements each formed of metallic or thermoplastic resin single body.

Further, even when a pulling force in the right/left direction is applied to the right and left fastener stringers, the flange 5 never bites into a gap between the adjacent fastener elements 22. Therefore, the conventional problem that the flange biting into the gap between the fastener elements thereby stopping a sliding motion of the slider is prevented, so that the slider can be operated smoothly. Therefore, there are remarkable effects obtained by this invention.

What is claimed is:

1. A slider for a slide fastener comprising:

a pair of flanges erected on one of an upper wing plate and a lower wing plate of a slider body toward an other upper wing plate and an other lower wing plate, the pair of flanges comprising:

a wide end face portion at a front end of each of the pair of flanges located at a shoulder side of the body, a front end of said wide end face portion being formed linearly;

top surfaces of the flanges comprising a flat surface portion in parallel to the upper wing plate and lower wing plate; and a protruded portion being formed on the flat surface portion of the top surface of each of the flanges from the front end located at the shoulder side to a central portion of the flange such that the protruded portion is protruded toward the other wing plates.

2. A slider for a slide fastener according to claim 1, wherein the wide end face portion is provided at a rear end located at a rear mouth side of the flange, while the flange is entirely formed in a large width.

3. A slider for a slide fastener according to claim 1, wherein the protruded portion formed on the top surface of the flange is formed along an inner edge of the flange from the front end of the flange.

4. A slider for a slide fastener according to claim 1, wherein a slope portion is formed on a border between the protruded portion formed on the top surface of the flange and the flat surface portion.

5. A slider for a slide fastener according to claim 1, wherein the top surface of the flange has at least a width for covering a single wale of a warp knitted fastener tape.

6. A slider for a slide fastener according to claim 1, wherein the wide end face portion provided at the front end of the flange has a lateral width larger than a gap between adjacent fastener elements of the fastener elements attached to a side edge of a fastener tape.

* * * * *